US009548156B2

(12) United States Patent
Kawai

(10) Patent No.: US 9,548,156 B2
(45) Date of Patent: Jan. 17, 2017

(54) IGNITION COIL FOR INTERNAL COMBUSTION ENGINE

(71) Applicant: DENSO CORPORATION, Kariya, Aichi-pref. (JP)

(72) Inventor: Kazuhide Kawai, Kariya-shi, Aichi-ken (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/002,805

(22) Filed: Jan. 21, 2016

(65) Prior Publication Data

US 2016/0211072 A1 Jul. 21, 2016

(30) Foreign Application Priority Data

Jan. 21, 2015 (JP) ..... 2015-009325

(51) Int. Cl.

| | |
|---|---|
| ***H01F 27/29*** | (2006.01) |
| ***H01F 38/12*** | (2006.01) |
| ***F02P 3/02*** | (2006.01) |
| ***H01T 15/00*** | (2006.01) |
| ***H01F 27/24*** | (2006.01) |
| ***H01F 27/32*** | (2006.01) |

(52) U.S. Cl.

CPC ..... *H01F 38/12* (2013.01); *F02P 3/02* (2013.01); *H01F 27/24* (2013.01); *H01F 27/29* (2013.01); *H01F 27/327* (2013.01); *H01T 15/00* (2013.01)

(58) Field of Classification Search

CPC ..... H01F 27/00; H01F 38/12
USPC ... 336/65, 107, 192, 198, 220–223; 123/634
See application file for complete search history.

(56) References Cited

FOREIGN PATENT DOCUMENTS

JP 2011-035019 2/2011

*Primary Examiner* — Tuyen Nguyen
(74) *Attorney, Agent, or Firm* — Nixon & Vanderhye P.C.

(57) ABSTRACT

An ignition coil for an internal combustion engine includes a wire-wound resistor. The wire-wound resistor includes a core material, a conductor winding, a pair of metal caps disposed at both ends of the core material, the pair of metal caps in contact with the conductor winding, and a resin coating material disposed so as to be in close contact with the core material and the conductor winding. The resin coating material is filled between the conductive winding and the resin coating material is formed to cover the conductor winding from an outer peripheral side of the conductor winding The metal cap includes a bottom portion and a cylindrical side portion. An inner peripheral side of the side portion is provide with ridges projecting internally formed along a direction crossing a winding direction of the conductor winding.

4 Claims, 7 Drawing Sheets

IGNITION COIL FOR INTERNAL COMBUSTION ENGINE

CROSS-REFERENCE TO RELATED APPLICATION

This application is based on and claims the benefit of priority from earlier Japanese Patent Application No. 2015-9325 filed Jan. 21, 2015, the description of which is incorporated herein by reference.

TECHNICAL FIELD

The present disclosure relates to an ignition coil for an internal combustion engine.

BACKGROUND

There is known an ignition coil for an internal combustion engine that has a coil body formed by accommodating a primary coil and a secondary coil within an insulating body case, and a high-voltage tower formed by disposing a high-voltage output terminal that is electrically connected to the secondary coil as well as projecting from the coil body towards a tip side thereof inside the high-voltage tower.

An ignition coil that has a resistive element inserted and disposed in a space at a tip side of the high-voltage output terminal in the high-voltage tower is disclosed in the Japanese Patent Application Laid-Open Publication No. 2011-35019.

As the resistive element, a wire-wound resistor can be used.

The wire-wound resistor has an insulating core material, a conductor winding wound spirally on an outer periphery of the core material, and metal caps disposed at both ends of the core material in an axial direction.

However, the following problems may occur in the ignition coil with the wire-wound resistor as described above.

That is, in the wire-wound resistor, the metal caps are required to be disposed at both ends of the core material in the axial direction as conduction terminals so as to contact the conductor windings from an outer peripheral side thereof.

Further, in order to prevent the conductor windings from becoming displaced in the axial direction relative to the core material, resin is required to be filled between parts of the conductor windings that are adjacent in the axial direction in an outer peripheral surface of the core material.

Here, the conductor windings are required to be exposed from the resin at the outer periphery thereof so that the conductor windings and the metal caps can be contacted.

However, since it is difficult to dispose the resin reliably between the parts of the conductor windings that are adjacent in the axial direction while exposing the entire outer peripheral surface of the conductor windings, in practice, a state is likely to occur where the parts of the outer peripheral surface in the conductor windings that are exposed and the parts that do not are not exposed coexist.

In such a state, creeping discharge may occur to the exposed conductor windings from the metal caps via a surface of the resin.

If creeping discharge occurs, this creeping discharge may become electromagnetic noise and is likely to affect peripheral devices.

Moreover, in the long term, there is also a concern the breakage of the conductor winding may occur due to the creeping discharge due to a deterioration of the resin between the conductive windings.

Here, it is conceivable to prevent the creeping discharge and damage of the conductor windings from occurring by preventing the exposure of the conductor windings by covering the entire conductor windings from the outer periphery thereof by the resin.

However, in this case, a problem that electrical conduction between the conductor windings and the metal caps become difficult may occur.

SUMMARY

An embodiment provides an ignition coil for an internal combustion engine that can ensure electrical conduction between a metal cap and a conductive winding while reliably preventing exposure of the conductive winding.

An ignition coil for an internal combustion engine in a first aspect includes a coil body formed by accommodating a primary coil and a secondary coil within a body case having an insulating property, a high-voltage tower formed by disposing a high-voltage output terminal that is electrically connected to the secondary coil as well as projecting from the coil body towards a tip side of the coil body inside the high-voltage tower, and a wire-wound resistor constituting at least a part of a conductive path from the high-voltage output terminal to a spark plug.

The wire-wound resistor includes an insulating core material, a conductor winding wound spirally on an outer periphery of the core material, a pair of metal caps disposed at both ends in an axial direction of the core material, the pair of metal caps contacting the conductor winding, and a resin coating material disposed so as to be in close contact with the core material and the conductor winding.

The resin coating material is filled between the conductive winding in the axial direction and the resin coating material is formed to cover the conductor winding from an outer peripheral side of the conductor winding.

The metal cap includes a bottom portion that faces the core material in the axial direction, and a cylindrical side portion protruding from an outer peripheral edge of the bottom portion in the axial direction.

An inner peripheral side of the side portion is provided with ridges projecting internally formed along a direction crossing a winding direction of the conductor winding.

In the ignition coil for the internal combustion engine mentioned above, the resin coating material is formed so as to cover the conductor winding from the outer peripheral side thereof.

Therefore, a state that the conductor winding is partially exposed from the resin coating material can be reliably prevented from being formed, and it is possible to prevent the creeping discharge from occurring.

In addition, troubles such as deterioration of the resin between the conductor windings due to the creeping discharge can also be prevented from occurring.

Further, the conductor winding can be prevented from being damaged when handling the wire-wound resistor during the manufacturing or the like of the ignition coil, for example, by preventing the conductive winding from being exposed from the resin coating material.

Further, the ridges projecting internally formed along the direction crossing the winding direction of the conductor winding are disposed on the inner peripheral side of the side portion of the metal cap.

Therefore, the ridges of the metal cap can contact the conductor winding by breaking the resin coating material.

Thereby, even without exposing the conductive winding from the resin coating material, it is possible to ensure an electrical conduction between the metal cap and the conductive winding.

As described above, according to the present disclosure, it is possible to provide the ignition coil for the internal combustion engine that can ensure electrical conduction between the metal cap and the conductive winding while reliably preventing the exposure of the conductive winding.

DETAILED DESCRIPTION OF THE PREFERABLE EMBODIMENT

An ignition coil for an internal combustion engine can be used for an internal combustion engine of, for example, an automobile, or a cogeneration system, etc.

In the present specification, a direction in which a central axis of a high-voltage tower extends is defined as an axial direction.

Further, a projecting side of the high-voltage tower in the axial direction relative to the body case is defined as a tip side, while a side opposite to the tip side is defined as a base side.

Furthermore, when described merely a radial direction or a circumferential direction, is meant a radial direction or a circumferential direction of the high-voltage tower, respectively, unless otherwise specified.

Embodiment

An embodiment of an ignition coil 1 for an internal combustion engine will be described with reference to FIGS. 1 to 10.

Figure 1:
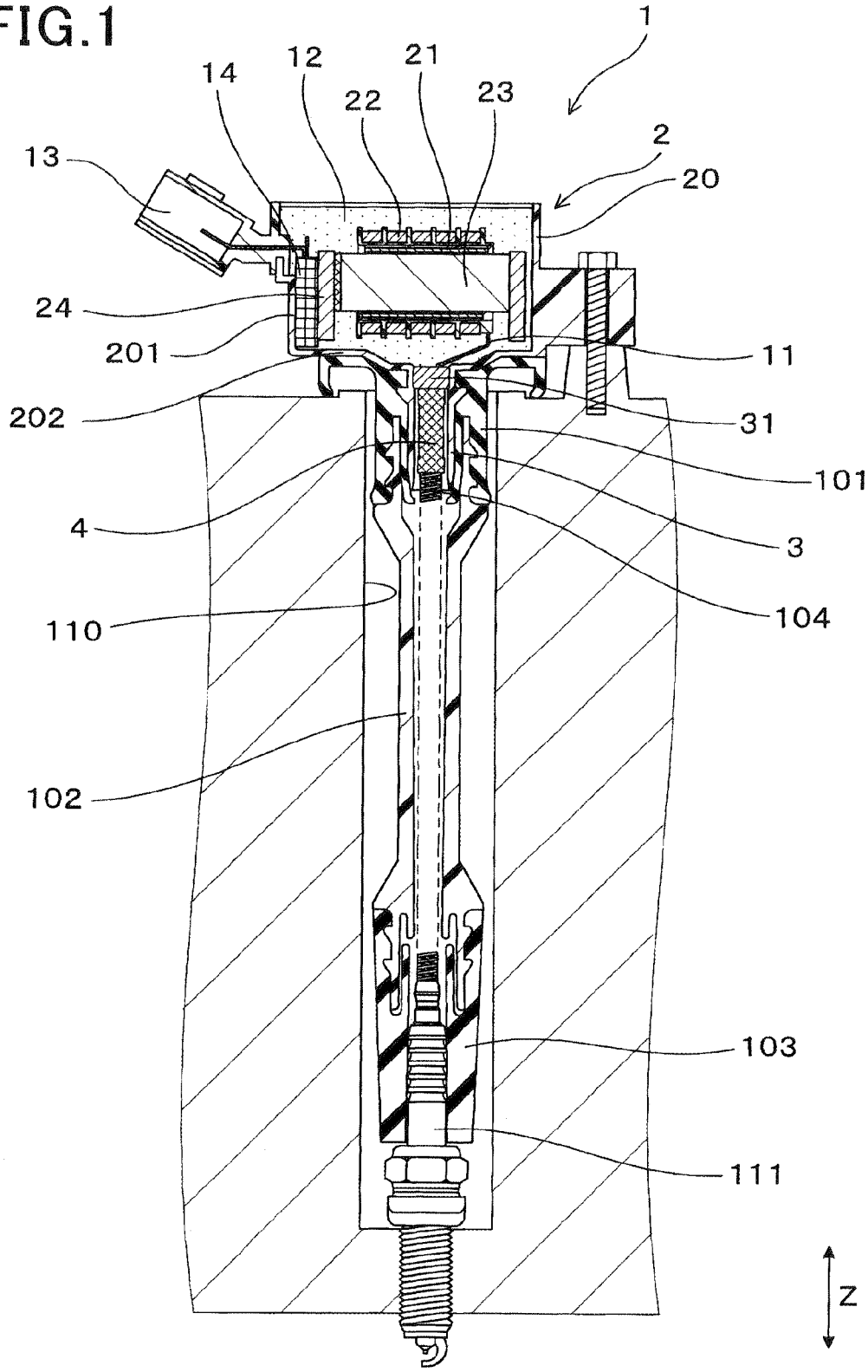
FIG. 1 shows a sectional view of an assembly structure of an ignition coil in an embodiment.

The ignition coil 1 for the internal combustion engine of the present embodiment includes a coil body 2, high-voltage tower 3, and a wire-wound resistor 4, as shown in FIG. 1.

The coil body 2 is formed by accommodating a primary coil 21 and a secondary coil 22 within a body case 20 having an insulating property.

Figure 2:
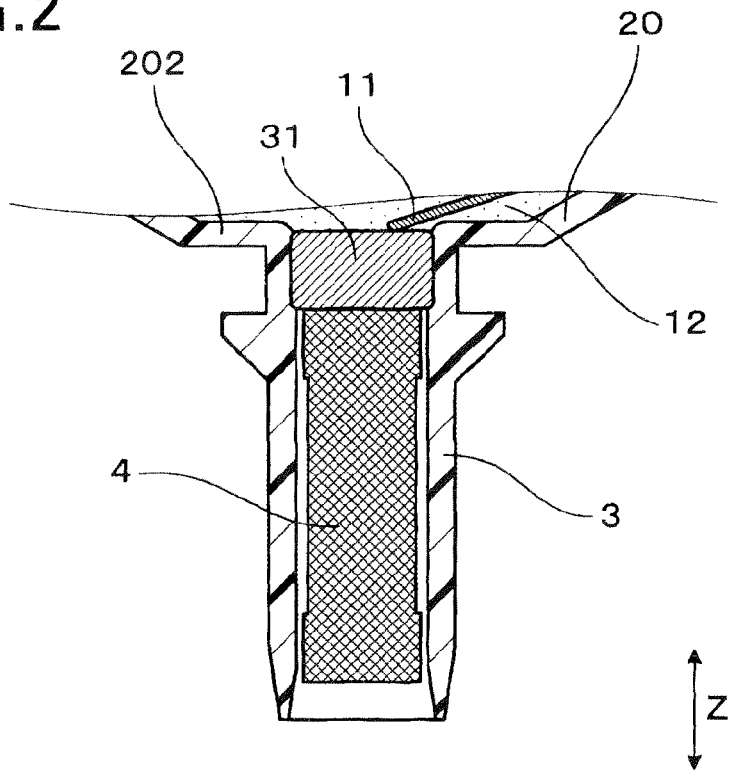
FIG. 2 shows a sectional view of the ignition coil in a vicinity of a wire-wound resistor in the embodiment.

As shown in FIGS. 1 and 2, the high-voltage tower 3 is formed by disposing a high-voltage output terminal 31 that is electrically connected to the secondary coil 22 as well as projecting from the coil body 2 towards a tip side thereof inside the high-voltage tower 3.

The wire-wound resistor 4 constitutes at least a part of a conductive path from the high-voltage output terminal 31 to a spark plug 111.

Note that in the present embodiment, the wire-wound resistor 4 is inserted and disposed inside the high-voltage tower 3 at the tip side of the high-voltage output terminal 31.

Figure 3:
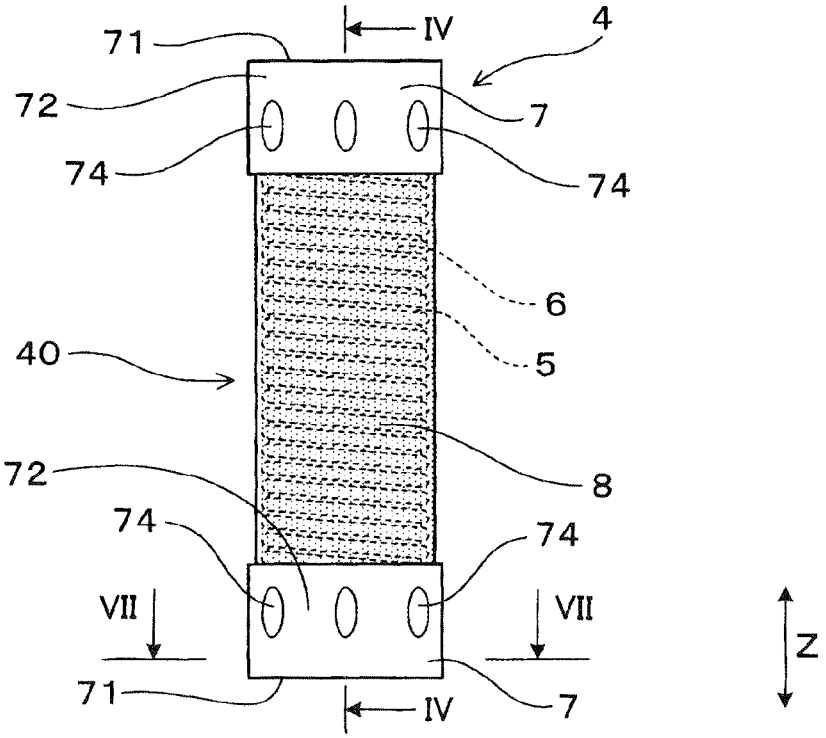
FIG. 3 shows a front view of the wire-wound resistor in the embodiment.
Figure 4:
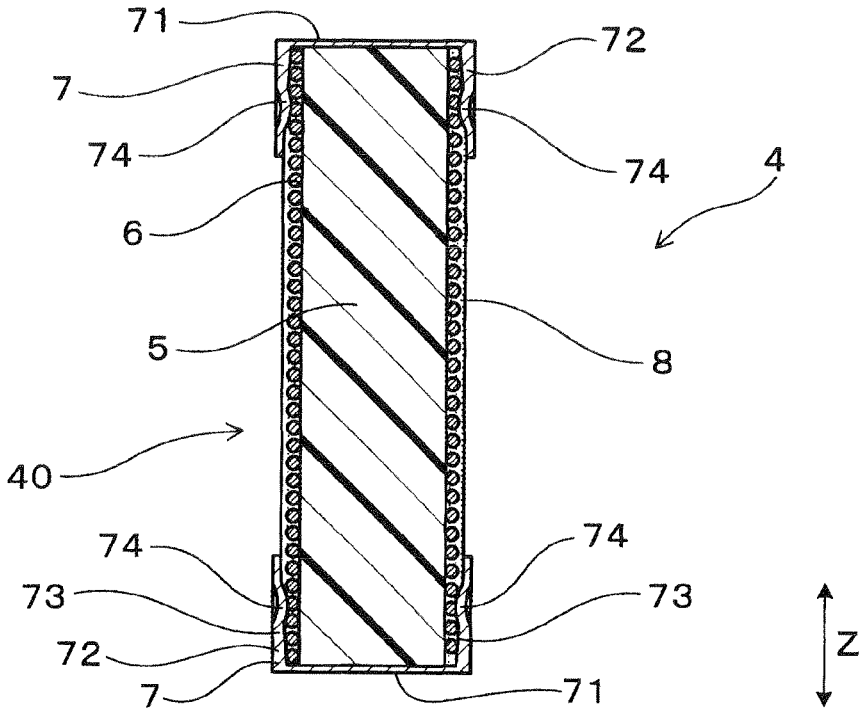
FIG. 4 shows a sectional view taken along the line IV-IV of FIG. 3.

As shown in FIGS. 3 and 4, the wire-wound resistor 4 includes a core material 5 having an insulating property, a conductor winding 6 wound spirally on the outer periphery of the core material 5, a pair of metal caps 7 disposed at both ends in an axial direction Z of the core material 5 that contact with the conductor winding 6, and a resin coating material 8 disposed so as to be in close contact with the core material 5 and the conductor winding 6.

The resin coating material 8 is filled between the conductive winding 6 in the axial direction Z while it is formed to cover the conductor winding 6 from an outer peripheral side thereof.

Figure 5:
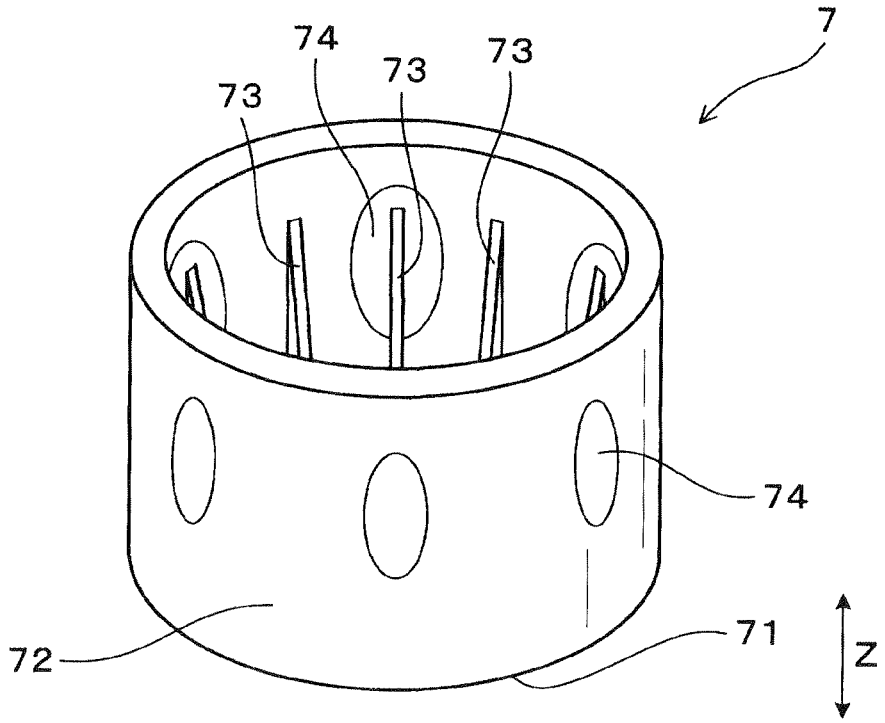
FIG. 5 shows a perspective view of a metal cap in the embodiment.
Figure 6:
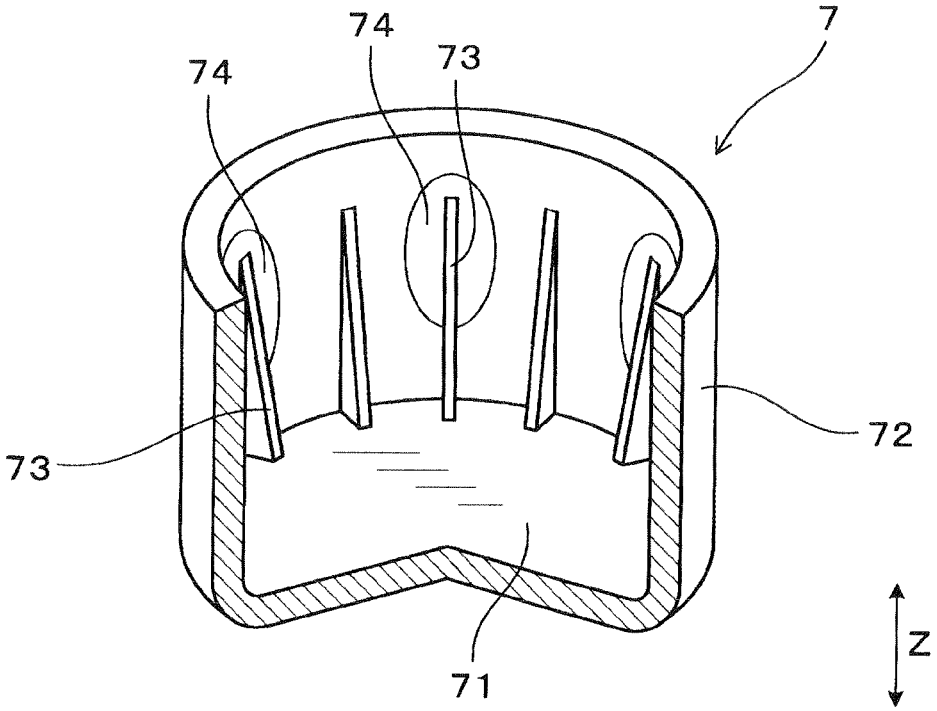
FIG. 6 shows a cutaway perspective view of the metal cap in the embodiment.

As shown in FIGS. 4 to 6, the metal cap 7 includes a bottom portion 71 that faces the core material 5 in the axial direction Z, and a cylindrical side portion 72 protruding from an outer peripheral edge of the bottom portion 71 in the axial direction Z.

As shown in FIGS. 4 to 8, an inner peripheral side of the side portion 72 is provide with ridges 73 projecting internally formed unitarily along a direction crossing a winding direction of the conductor winding 6.

As shown in FIG. 1, the primary coil 21 and the secondary coil 22 are disposed concentrically overlapping in a radial direction.

A center core 23 is inserted and disposed inside the primary coil 21 and the secondary coil 22.

An outer core 24 is disposed so as to surround outer peripheries of the primary coil 21 and the secondary coil 22 from a direction perpendicular to the axial direction Z.

The center core 23 and the outer core 24 are made of a soft magnetic material.

The body case 20 surrounds the primary coil 21, the secondary coil 22, the center core 23, and the outer core 24 from the direction perpendicular to the axial direction Z, as well as includes a case side wall portion 201 of which a base side is opened, and a case bottom wall portion 202 that closes a tip side of the case side wall portion 201.

As shown in FIGS. 1 and 2, the high pressure tower 3 of substantially cylindrical shape is formed projecting from the case bottom wall portion 202 toward the tip side.

The high-voltage output terminal 31 is press-fitted to a base of the high-voltage tower 3.

The high-voltage output terminal 31 is electrically connected to the secondary coil 22 via a connecting terminal 11.

A filling resin 12 having an electrical insulation property is filled into the body case 20 in an area in the base side than the high-voltage output terminal 31, the primary coil 21, the secondary coil 22 and the like are sealed.

The wire-wound resistor 4 is inserted and disposed to the tip side of the high-voltage output terminal 31 in the high-voltage tower 3.

A base surface of the wire-wound resistor 4 is in contact with a tip surface of the high-voltage output terminal 31.

An inner diameter of the high-voltage tower 3 is larger than an outer diameter of the wire-wound resistor 4.

Therefore, while interposing a gap between the wire-wound resistor 4 and an inner wall of the high-voltage tower 3, the wire-wound resistor 4 can be inserted and disposed inside the high-voltage tower 3.

A gap of about 0.05 to 1.00 mm, for example, is interposed between the wire-wound resistor 4 and the inner wall of the high-voltage tower 3.

In other words, the wire-wound resistor 4 is disposed in the high-voltage tower 3 in a state that is not embedded in the resin.

The core material 5 of the wire-wound resistor 4 is made by impregnating an epoxy resin to unify glass fibers, for example, and is an electrical insulator.

The core material 5 has a substantially cylindrical shape.

As shown in FIGS. 3 and 4, the conductor winding 6 in wound along an outer peripheral surface of the core material 5.

The conductor winding 6 is formed by spirally winding a fine wire, such as Ni—Cr alloy, Ni—Fe alloy or the like, for example.

The conductor winding 6 is wound all around the core material 5 in the axial direction Z.

A constant interval is disposed between portions of adjacent conductor winding 6 in the axial direction Z.

The core material 5 and the conductor winding 6 are covered with the resin coating material 8 from outer peripheral sides thereof.

The resin coating material 8 is filled around the conductor winding 6 in a region from an outer peripheral surface of the core material 5 to a position outer than a outer peripheral surface of the conductor winding 6 in a radial direction.

The resin coating material 8 is disposed in the entire area in the axial direction Z of the core material 5.

An outer peripheral surface of the wire-wound resistors 4 is formed by the resin coating material 8 except portions where the metal caps 7 are disposed.

The resin coating material 8 made of epoxy resin, for example.

The metal caps 7 made of metal are fitted to both ends in the axial direction Z of a winding structure 40 composed of the conductor winding 6 and the resin coating material 8.

As shown in FIGS. 3 to 6, each of the metal caps 7 has the substantially circular bottom portion 71 and the substantially cylindrical side portion 72 that is protruding from the outer peripheral edge of the bottom portion 71 to a side that the bottom portion 71 faces to the each other.

As shown in FIG. 4, each of the metal caps 7 is open to a side facing each other.

Respective bottom portions 71 of the respective metal caps 7 is in contact with respective end surfaces of the core material 5 in the axial direction Z.

However, the bottom portion 71 and the end surfaces of the core materials 5 are not necessarily in contact with each other.

The side portion 72 covers conductor winding 4 from the outer peripheral side thereof.

As shown in FIGS. 4 to 7, the metal cap 7 has a plurality of ridges 73 projecting internally on the side portion 72.

Figure 7:
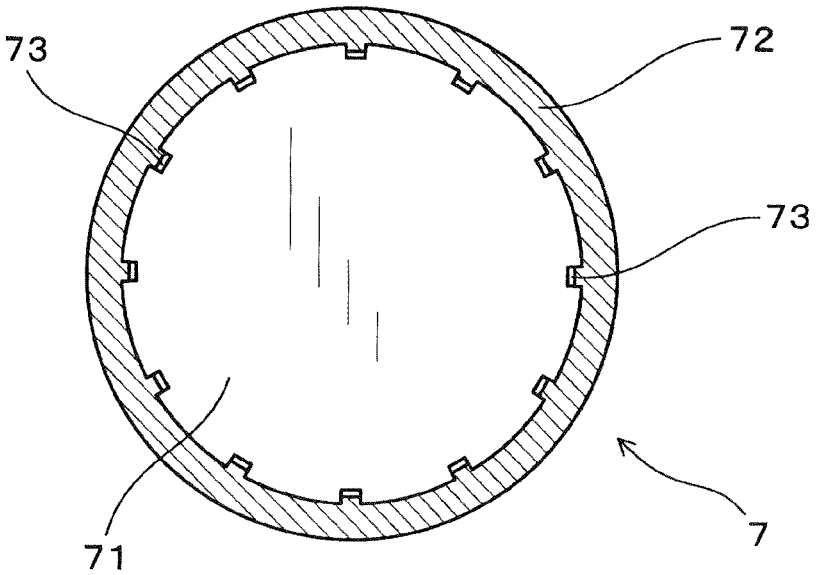
FIG. 7 shows a sectional view taken along the line VII-VII of the metal cap in FIG. 3.

As shown in FIG. 7, the metal cap 7 is provided with three or more ridges 73 disposed at equal intervals in a circumferential direction.

In the present embodiment, twelve ridges 73 are formed.

Figure 8:
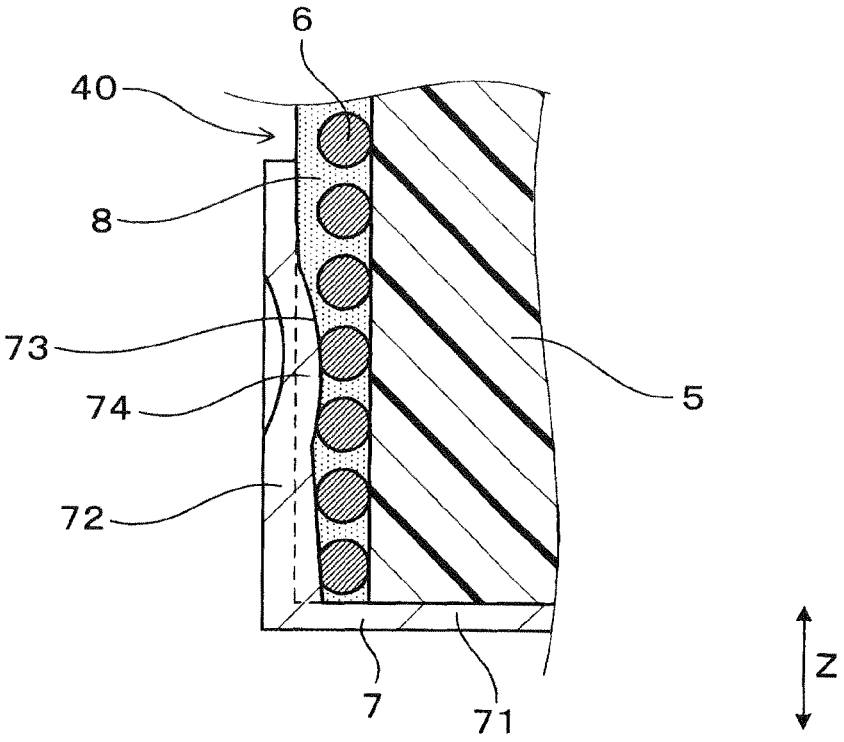
FIG. 8 shows an enlarged sectional view of a state in which a ridge and the conductor winding are in contact in the embodiment.

As shown in FIGS. 4, 6, and 8, the ridges 73 are formed along the axial direction Z.

The ridges 73 are continuously formed in the axial direction Z from the bottom portion 71 to a position in middle of a way to an open end of the metal cap 7.

The ridge 73 has a shape such that a projecting height decreases as it goes farther from the bottom portion 71.

That is, the ridge 73 has a tapered shape in the axial direction Z that the projecting height in the radial direction is reduced gradually as it goes toward the opening side of the metal cap 7 from the bottom portion 71.

Furthermore, the projecting height in the radial direction of the ridge 73 has at least one portion in the radial direction greater than the thickness of the resin coating material 8 at the outer periphery of the conductor winding 6.

As shown in FIGS. 3 to 6, and 8, the metal cap 7 attached to the winding structure 40 has crimped portions 74 that are portions crimped inwardly in the radial direction from the outer peripheral side of the conductor winding 6 in the side portion 72.

The crimped portions 74 are formed at a plurality of positions in the circumferential direction of the side portion 72.

In the present embodiment, the crimped portions 74 are provided in the six positions in the circumferential direction with equal intervals in the side portion 72.

The crimped portions 74 are formed at positions overlapping with the ridges 73 in the radial direction.

As shown in FIGS. 4, 6, and 8, at least a part of the crimped portion 74 is formed on the opening side of the metal cap 7 from a center portion of the ridge 73 in the axial direction Z.

As shown in FIG. 8, the metal cap 7 is in contact with the conductive winding 6 at the ridges 73.

That is, the ridges 73 are in direct contact with the conductor winding 6 breaking the resin coating material 8 from the outer peripheral side.

Among the twelve ridges 73, at least the ridges 73 overlapping with the crimped portions 74 in the radial direction are in direct contact with the conductor winding 6.

The width of the ridge 73 in the circumferential direction is equal to or less than the thickness of the metal cap 7, for example.

As shown in FIG. 1, the high-voltage tower 3 is assembled with a substantially cylindrical joint 102 via a seal rubber 101.

The joint 102 is inserted and disposed in a plug hole 110 of an engine.

A spring 104 for electrically connecting the high-voltage output terminal 31 and the spark plug 111 is inserted and disposed in the joint 102.

Then, the secondary coil 22 is electrically connected to the spark plug 111 via the connecting terminal 11, the high-voltage output terminal 31, the wire-wound resistor 4, and the spring 104.

The wire-wound resistor 4 is electrically connected to the spark plug 111 via the spring 104 at the metal cap 7 on the tip side of the wire-wound resistor 4.

Note that details of the wire-wound resistor 4 are not shown in FIGS. 1 and 2.

Further, the core material 5 and are conductor winding 6 are denoted by dashed lines in FIG. 3.

Figure 10:
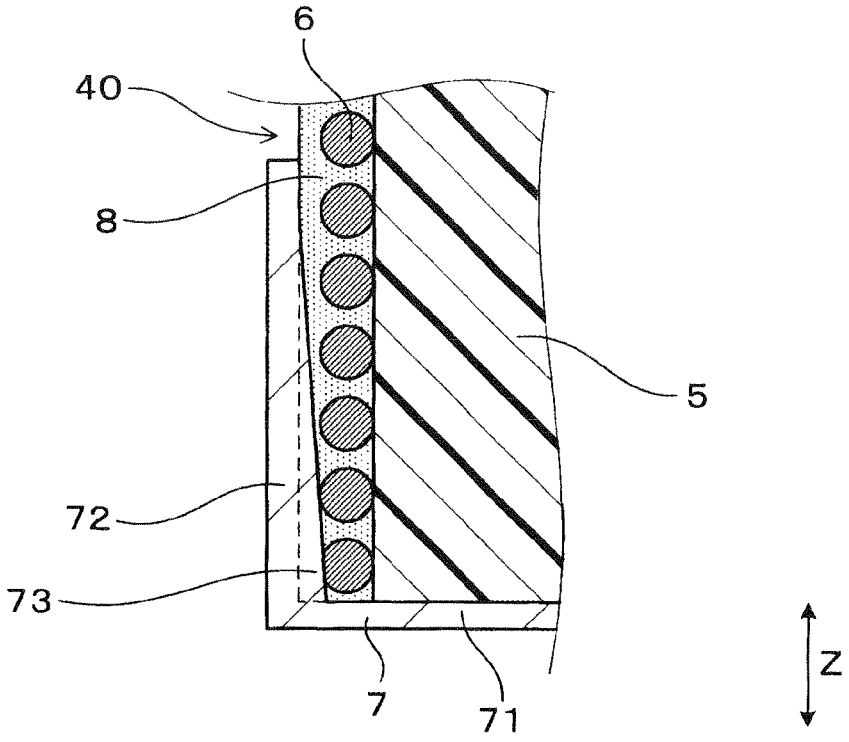
FIG. 10 shows an enlarged sectional view of a state before crimping the metal caps in the embodiment.

Furthermore, the outer periphery of the resin coating material 8 before being broken is denoted by the dashed lines n FIGS. 8 and 10.

Further, a reference numeral 13 shows a connector for connecting the ignition coil 1 to an external device, and a reference numeral 14 shows an igniter for performing a supply and a cutoff of the power supply to the primary coil 21 in FIG. 1.

Next, a method of manufacturing the wire-wound resistor 4 is described with reference to FIGS. 8 to 10 and the like.

The fine wire is spirally wound along the outer peripheral surface of the core material 5 to form the conductor winding 6 around the core material 5.

Then, the resin coating material 8 is disposed on the core material 5 to which the conductor winding 6 is assembled from the outer peripheral side of the core material 5.

At this time, the resin coating material 8 is filled between the conductive winding 6 in the axial direction Z, as well as so as to cover the conductor winding 6 from the outer peripheral side.

Thus, the winding structure 40 is manufactured.

Next, the respective metal cap 7 is fitted to the winding structure 40 from both sides of the winding structure 40 in the axial direction Z.

Figure 9:
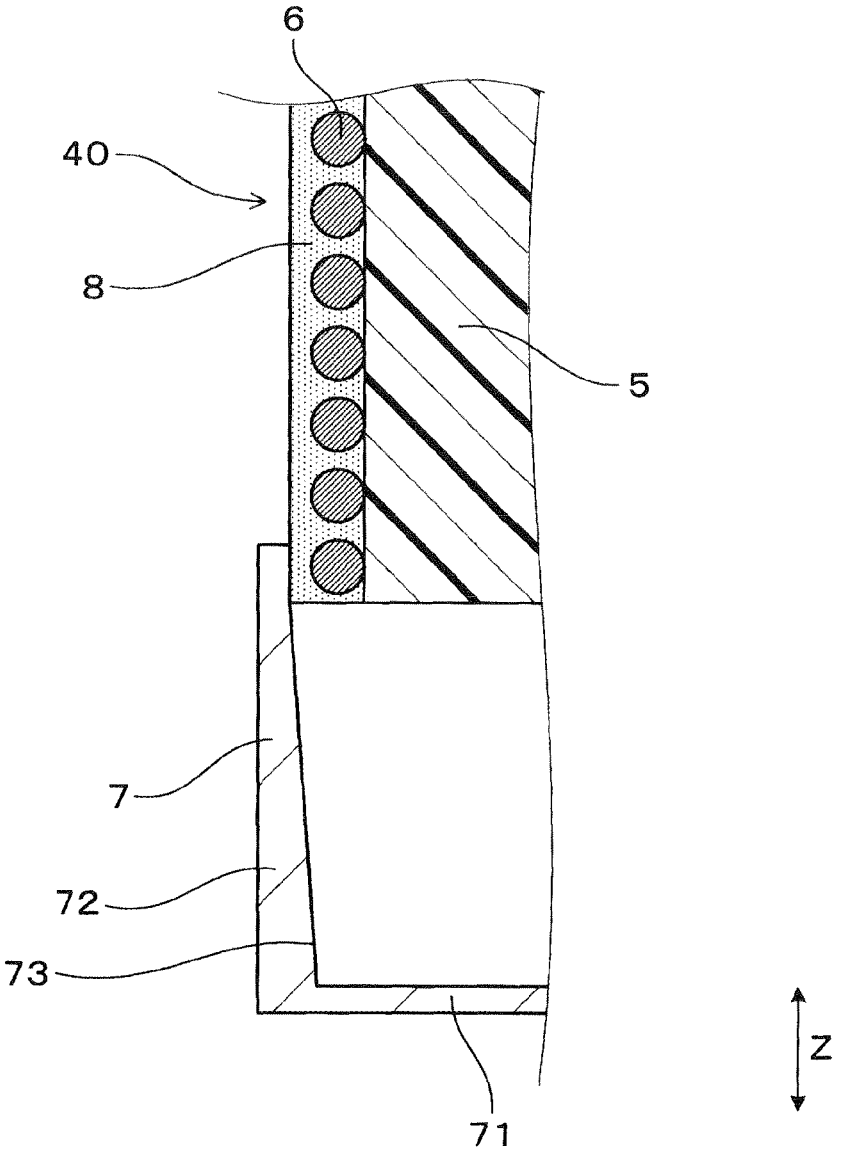
FIG. 9 shows an enlarged sectional view of a state in which a portion of the metal cap at an opening side than the ridge is fitted to a winding structure in the embodiment.

First, as shown in FIG. 9, a portion of the metal cap 7 in the opening side than the ridges 73 is fitted to an end of the winding structure 40.

From this state (refer to FIG. 9), the metal cap 7 is further pushed towards the winding structure 40 in the axial direction Z, thus the ridges 73 interfere with the resin coating material 8, and break the resin coating material 8.

Then, as shown in FIG. 10, the metal cap 7 is pushed to the winding structure 40 until the bottom portion 71 of the metal cap 7 abuts the end surface of the winding structure 40 in the axial direction Z.

At this time, the metal cap 7 is brought into contact with the conductive winding 6 at a portion of the ridge 73 closer to the bottom portion 71.

However, the ridges 73 may not necessarily be in contact with the conductive winding 6 at this stage.

Next, as shown in FIG. 8, the side portions 72 of the metal cap 7 are crimped inwardly in the radial direction at the plurality of positions in the circumferential direction to form the crimped portions 74.

At this time, the metal cap 7 is crimped until the ridges 73 disposed at the positions overlapping with the crimped portions 74 in the radial direction contact the conductor winding 6.

In other words, the ridges 73 disposed at the positions overlapping with the crimped portions 74 are displaced inwardly in the radial direction by crimping the metal cap 7.

Accordingly, the ridges 73 push aside the resin coating material 8 and contact with the conductive winding 6.

Thereby, the metal cap 7 can be reliably contacted with the conductor winding 6 at the ridges 73.

Accordingly, it is possible to manufacture the wire-wound resistor 4.

Next, function and effect of the present embodiment we will be described.

In the ignition coil 1 for the internal combustion engine, the resin coating material 8 is formed so as to cover the conductor winding 6 from the outer peripheral side thereof.

Therefore, a state that the conductor winding 6 is partially exposed from the resin coating material 8 can be reliably prevented from being formed, and it is possible to prevent the creeping discharge from occurring.

In addition, damages to the conductor winding 6 due to the creeping discharge or an assembling of the metal cap 7 can also be prevented from occurring.

Further, the conductor winding 6 can be prevented from being damaged when handling the wire-wound resistor 4 during the manufacturing or the like of the ignition coil 1, for example, by preventing the conductive winding 6 from being exposed from the resin coating material 8.

Further, the ridges 73 projecting internally formed along the direction crossing the winding direction of the conductor winding 6 are disposed on the inner peripheral side of the side portion 72 of the metal cap 7.

Therefore, the ridges 73 of the metal cap 7 become possible to contact with the conductor winding 6 by breaking the resin coating material 8.

Thereby, even without exposing the conductive winding 6 from the resin coating material 8, it is possible to ensure electrical conduction between the metal cap 7 and the conductive winding 6.

Further, the ridge 73 has a shape such that the projecting height decreases as it goes farther from the bottom portion 71.

Therefore, while the fitting of the metal cap 7 to the winding structure 40 can be performed smoothly, it is possible to easily reliably contact the ridges 73 to the conductive winding 6.

In addition, each of the metal caps 7 is provided with three or more ridges 73 disposed at equal intervals in the circumferential direction.

Therefore, it is possible to ensure the contact between the ridges 73 and the conductor winding 6.

This makes it possible to reliably ensure the conduction between the conductor winding 6 and the metal cap 7.

As described above, according to the present embodiment, it is possible to provide the ignition coil for the internal combustion engine that can ensure electrical conduction between the metal cap and the conductive winding while reliably preventing the exposure of the conductive winding.

Note that although an example of forming the ridges along the axial direction in the above embodiment, the shape and the like are not intended to be especially limited as long as the ridges are formed along the direction crossing the winding direction of the conductor winding.

Further, although an example of forming the ridges in the axial direction from the bottom portion to the position in the middle of the way to the open end of the metal cap 7 is shown, it is not limited thereto.

For example, the ridge may also be formed on the entire side portion in the axial direction.

Further, although the crimped portions are formed in the six positions in the side portion, it is not limited thereto.

The crimped portions are preferably formed in three or more positions in the side portion.

Further, although an example of fixing the metal cap to the winding structure by crimping the metal cap to the winding structure in the above embodiment, it is not limited thereto.

For example, it is possible to ensure the metal cap to the winding structure by interposing adhesives between the end surface of the winding structure and the bottom portion of the metal cap.

Even in this case, it is possible to ensure the conduction between the ridges of the metal cap and the conductor winding.

Moreover, although an example that the wire-wound resistor is disposed inside the high-voltage tower is shown in the above embodiments, as long as the wire-wound resistor constitutes at least a part of the conductive path to the spark plug from the high-voltage output terminal structure, it is not limited thereto.

That is, even in a structure such that the wire-wound resistor is inserted and disposed in a part of inside the joint while disposing clearances around the wire-wound resistor, for example, it is still possible to achieve the effects of the present disclosure.

What is claimed is:

1. An ignition coil for an internal combustion engine comprising:

a coil body formed by accommodating a primary coil and a secondary coil within a body case having an insulating property;

a high-voltage tower formed by disposing a high-voltage output terminal that is electrically connected to the secondary coil as well as projecting from the coil body towards a tip side of the coil body inside the high-voltage tower; and a wire-wound resistor constituting at least a part of a conductive path from the high-voltage output terminal to a spark plug; wherein, the wire-wound resistor includes an insulating core material, a conductor winding wound spirally on an outer periphery of the core material, a pair of metal caps disposed at both ends in an axial direction of the core material, the pair of metal caps contacting with the conductor winding, and a resin coating material disposed so as to be in close contact with the core material and the conductor winding;

the resin coating material is filled between the conductive winding in the axial direction and the resin coating material is formed to cover the conductor winding from an outer peripheral side of the conductor winding;

the metal cap includes a bottom portion that faces the core material in the axial direction, and a cylindrical side portion protruding from an outer peripheral edge of the bottom portion in the axial direction; and an inner peripheral side of the side portion is provided with ridges projecting internally formed along a direction crossing a winding direction of the conductor winding.

2. The ignition coil for the internal combustion engine according to claim 1, wherein, the ridge has a shape such that a projecting height decreases as it goes farther from the bottom portion.

3. The ignition coil for the internal combustion engine according to claim 1, wherein, each of the metal caps is provided with three or more ridges disposed at equal intervals in a circumferential direction.

4. The ignition coil for the internal combustion engine according to claim 2, wherein, each of the metal caps is provided with three or more ridges disposed at equal intervals in a circumferential direction.

* * * * *